US006511013B2

(12) United States Patent
Reimann et al.

(10) Patent No.: US 6,511,013 B2
(45) Date of Patent: Jan. 28, 2003

(54) DEVICE FOR STARTING A WORK STATION OF A CHEESE-PRODUCING TEXTILE MACHINE

(75) Inventors: Michael Reimann, Grevenbroich (DE); Herbert Wellage, Hückelhoven (DE)

(73) Assignee: W. Schlafhorst AG & Co. (DE)

( * ) Notice: Subject to any disclaimer, the term of this patent is extended or adjusted under 35 U.S.C. 154(b) by 87 days.

(21) Appl. No.: 09/789,203

(22) Filed: Feb. 20, 2001

(65) Prior Publication Data

US 2001/0022071 A1 Sep. 20, 2001

(30) Foreign Application Priority Data

Feb. 22, 2000 (DE) ..... 100 07 950

(51) Int. Cl.[7] ..... B65H 54/22; D01H 9/00

(52) U.S. Cl. ..... 242/473.5; 242/474.1; 57/279

(58) Field of Search ..... 242/473.5, 473.6, 242/473.7, 473.8, 474.1, 474.2; 57/279

(56) References Cited

U.S. PATENT DOCUMENTS

| | | | | |
|---|---|---|---|---|
| 4,638,955 A | | 1/1987 | Schippers et al. | |
| 5,188,304 A | * | 2/1993 | Colli et al. | 242/474.1 |
| 5,676,322 A | * | 10/1997 | Stahlecker | 242/473.7 |
| 5,871,168 A | * | 2/1999 | Ruskens et al. | 242/474.2 |
| 6,270,033 B1 | * | 8/2001 | Haasen et al. | 242/474.1 |
| 6,328,247 B1 | * | 12/2001 | Fechter et al. | 242/473.5 |

FOREIGN PATENT DOCUMENTS

| | | |
|---|---|---|
| DE | 24 63 461 C2 | 9/1990 |
| DE | 40 05 752 A1 | 8/1991 |
| DE | 195 33 833 A1 | 3/1997 |
| DE | 198 36 702 A1 | 2/2000 |
| DE | 198 58 548 A1 | 6/2000 |
| JP | 3-95071 | 4/1991 |
| JP | 8-059086 | 3/1996 |
| JP | 10-297826 | 11/1998 |

OTHER PUBLICATIONS

German Search Report.
Japanese Patent Abstract of JP09202521A Publ. Aug. 5, 1997, Title—Doffing Device.
European Search Report –EP 01100952.

* cited by examiner

*Primary Examiner*—Michael R. Mansen
(74) *Attorney, Agent, or Firm*—Kennedy Covington Lobdell & Hickman, LLP

(57) ABSTRACT

A device for starting a work station (2) of a cheese-producing textile machine, in particular after a batch change, wherein the work station (2) has a creel (18) for rotatably holding a bobbin tube (34), a splicing device (13) for connecting yarn ends, and manipulating means (12, 24) for inserting the yarn ends into the splicing device (13). A yarn (28) connected with a feed bobbin (9) is placed into the splicing device (13) by means of a gripper tube (24). The winding station has a device (30) for cutting the yarn (28), and a device (26) for receiving the cut yarn (28). A special suction tube (1) makes possible the transfer of the cut yarn (28) to a second clamping and cutting device (23) arranged in the area of the creel (18).

4 Claims, 4 Drawing Sheets

DEVICE FOR STARTING A WORK STATION OF A CHEESE-PRODUCING TEXTILE MACHINE

CROSS-REFERENCES TO RELATED APPLICATIONS

This application claims the benefit of German patent application 10007950.4 filed Feb. 22, 2000, herein incorporated by reference.

FIELD OF THE INVENTION

The present invention relates to a device for starting a work station of a cheese-producing textile machine, especially after a batch change, and relates more particularly to such a device wherein the work station has a creel for rotatably holding a bobbin tube on which a cheese of yarn is to be wound from a feeding bobbin or cop, a splicing or yarn connecting device for connecting yarn ends form the cheese and the cop, and manipulating means for inserting the yarn ends into the splicing device, for example a gripper tubes or other like devices for inserting a trailing yarn end from the cheese and a leading yarn end from a feeding cop into a yarn clamping and cutting device arranged in the area of the splicing device.

BACKGROUND OF THE INVENTION

In connection with the operation of cheese-producing textile machines, in particular automatic cheese winders, it is customary in case of a yarn break or a change of the feeding bobbin to initially activate an automatic yarn splicer or like yarn connecting device via a computer associated with the respective bobbin winding head, as described, for example, in German Patent Publication DE 40 05 752 A1. More specifically, a suction nozzle is first placed into contact with the surface of the upper winding bobbin, also referred to as a cheese, which slowly rotates opposite the normal winding direction, in order to unwind a length of the trailing yarn end from the cheese to be aspirated into the suction nozzle. After the upper yarn end from the upper cheese has been grasped, the suction nozzle is pivoted back into its initial position, in which the suction nozzle opening is positioned below a splicing device. In the process, the section of yarn extending between the cheese and the suction nozzle is pulled into an electronic cleaner arranged above the splicing device and into a clamping and cutting device positioned in this area and, also is guided by appropriate guide contours of yarn guide plates and yarn guide hoops, into the cutter portion of a cutting device located below the splicing device.

Almost simultaneously with the suction nozzle, a gripper tube, which is positioned in a lower initial position, pivots into an upper work position and in the process brings along a leading end of the bottom yarn from the feeding bobbin, also referred to as a cop, which theretofore had been drawn off the cop and had been held in a yarn tensioner. In the course of the gripper tube pivoting into its upper work position, the leading end of the bottom yarn from the cop is also guided by appropriate yarn guide contours and slides into an opened yarn clamp, as well as an opened cutting device. Subsequently the upper and lower yarn ends are cut to the correct length, are prepared in so-called opening tubes and are connected with each other in the splicing device.

Accordingly, an upper yarn brought downwardly from the cheese and a lower yam brought upwardly from the feeding cop are always needed in order to be able to automatically continue the operation at the work stations of an automatic cheese winder, for example after a yam break. Likewise, when a fully wound cheese is to be replaced with an empty bobbin tube, it must be correspondingly assured that the bottom yarn from the feeding cop extends sufficiently into the area of the empty cheese tube held in the creel of the respective work station so as to be fastened on the empty tube.

In bobbin winding machines which have an automatically operating service traveler, generally called a cheese changer, it is known (e.g., from German Patent Publication DE 195 33 833 A1) that, in case of a cheese/empty tube change, the yarn still tensed between the feeding cop and the finished cheese is initially picked up by a special manipulating device of the service traveler, a so called yarn lifter, and is severed by cutting and clamping elements arranged on the yarn lifter. In the process the yarn end from the feeding cop is retained and is subsequently placed against the new empty tube positioned in the creel.

It is furthermore known, for example from German Patent Publication DE 24 63 461 C2, to respectively install a separate clamping and cutting device dedicated to the bobbin winding head in the area of the creel of each individual work station which, in case of a cheese/empty tube change, fixes the yarn in place prior to ejecting the cheese so that thereafter the yarn is ready to be placed against a new empty tube.

However, the above described devices have the disadvantage that they are ineffective in case of a batch change, i.e. when the yam material is changed in a bobbin winding machine and the appropriate new feeding cops are brought into the work stations. In such batch changes, it will therefore be understood that neither an upper nor a bottom yam will be present to start each work station. Therefore, a manual intervention by the operators has always been required heretofore in the case of a batch change in order to start up every individual bobbin winding head.

OBJECT AND SUMMARY OF THE INVENTION

Based on the above mentioned state of the art, it is an object of the present invention to further improve the known work stations of cheese-producing textile machines.

This object is attained in accordance with the present invention by means of a device having the particular advantage that, after a batch change, the individual work stations of the cheese-producing textile machines can be automatically returned to operation without any manual intervention by the operators. Thus, not only is the length of time for restarting the automatic cheese winder considerably shortened in this manner, and therefore the efficiency of the respective textile machine clearly increased, but the workload of the operators is also noticeably relieved.

In a preferred embodiment, the device has an additional suction tube, defined by a stepper motor and pivotable from a yarn pick-up position into a yarn transfer position. This suction tube, which can be charged with a vacuum, automatically picks up the yarn end which previously had been brought from the gripper tube to the splicing device and had been cut by a cutting device arranged thereat, and which then lies on an interim location of deposit, i.e. a deposit plate, and transports it to a clamping and cutting device arranged in the area of the cheese creel, which subsequently makes the yarn available for transfer to the empty tube.

Further details, features and advantages of the present invention will be understood from an exemplary embodiment described below with reference to the accompanying drawings.

DETAILED DESCRIPTION OF THE PREFERRED EMBODIMENT

Figure 1:
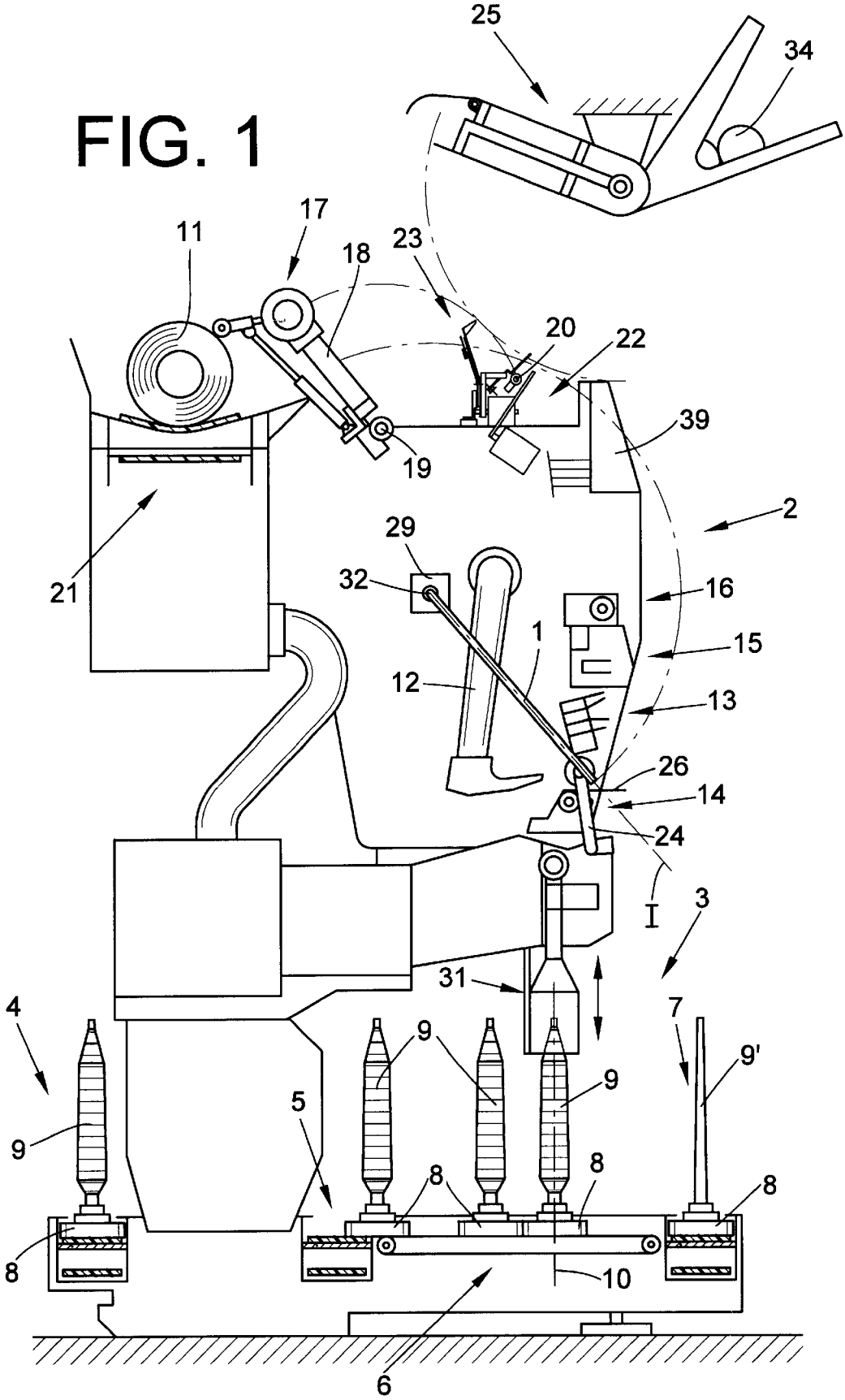
FIG. 1 is a schematic lateral view of a work station of an automatic cheese winder with a device in accordance with the present invention, and FIGS. 2 to 6 sequentially represent the individual process steps when employing the device in accordance with the invention.

A work station 2 of a cheese-producing textile machine, in the exemplary embodiment an automatic cheese winder, is schematically represented in a lateral view in FIG. 1. Such automatic cheese winders customarily have a plurality of such identical work stations, in this case bobbin winding heads 2, aligned with one another between their end frames. The spinning cops 9, produced on a ring spinning machine (not represented), are rewound into larger volume cheeses 11 at these bobbin winding heads 2, in a manner which is known and therefore need not be further explained herein.

After the cheeses 11, which are held in a pivotably seated creel 18 during the winding process, are finished, they are transferred by means of an appropriate pivoting of the creel 18 around a pivot shaft 19 to a cheese transporting device 21, which is arranged behind the winding devices of the work stations 2. The cheeses 11 are then transported by means of the cheese transporting device 21 to a bobbin loading station or the like (also not represented), which is arranged at the end of the textile machine.

As a rule, such automatic cheese winders in addition have a logistic device in the form of a bobbin and tube transport system 3. Yarn-wound spinning cops 9, or empty unwound cop tubes 9, are supported in vertical orientation on transport plates 8 to be circulated in this bobbin and tube transport system 3.

Furthermore, such automatic cheese winders have a central control unit in most cases, which is connected via a machine bus with the individual work station computers 39 of the bobbin winding heads 2.

Of the relatively extensive bobbin and tube transport system 3 mentioned above, only the cop feed track 4 which extends over the length of the machine, the reversible storage track 5 which extends behind the bobbin winding heads 2, one of the transverse transport tracks 6 which leads to the bobbin winding heads 2, and the tube return track 7, are represented in FIG. 1.

The spinning cops 9 delivered over the cop feed track 4 are rewound into larger volume cheeses 11 in unwinding positions 10, each of which is located in the area of a respective one of the transverse transport tracks 6 at the bobbin winding heads 2. To this end, the individual work stations have various devices, which are known per se and are therefore not explained, and which assure the correct operation of these work stations 2.

For example, in FIG. 1 a suction nozzle is indicated at 12, a gripper tube at 24, a splicing device at 13, a yarn tensioning device at 14, a yarn cleaner with a yarn cutting device at 15, and a paraffin application device at 16. The winding drive which, in the present embodiment is integrated into the creel 18, is designated by the reference numeral 17.

During the winding process, the cheese 11 is held in bobbin receiver plates of the creel 18 and rests with its surface on a support roller 20. In the course of this operation, the support roller 20 is moved along by being frictional connection with the driven cheese 11.

A yarn traversing device 22, such as is described in German Patent Publication DE 198 58 528 A1, for example, has been installed in the area of the support roller 20.

Furthermore, the individual bobbin winding heads 2 each have definitively controllable clamping and cutting devices 23 in the area of their support rollers 20. Such clamping and cutting devices are the subject of a parallel patent application of Applicant.

As can be additionally seen from FIG. 1, the individual bobbin winding heads 2 have their own empty tube reservoir 25, which can be acted upon by the creel 18 of the bobbin winding head to remove empty tubes therefrom, such as is known from German Patent Publication DE 25 57 304 B.

In accordance with the present invention, each bobbin winding head 2 is also equipped with a definitively controllable suction tube I; as well as with a deposit plate 26, which is arranged in the area of the yarn tensioner 14.

The device of the present invention functions as follows. At the start of the winding operation, i.e. after a batch change, the individual bobbin winding heads 2 of the automatic cheese winder are first provided with spinning cops 9 from the fresh yam batch.

Thus, every bobbin winding head 2 receives at least one spinning cop 9 via the transverse transport track 6, which cop is then fixed in place in an unwinding position 10 in the area of the bobbin winding head 2.

Thereafter, the leading end of yarn 28 from each cop which, for example, is made available at the tube tip of the spinning cop 9, is blown upward in a customary manner by a yarn end removal device 31 arranged in the unwinding position 10 of the work station 2, and is received by the gripper tube 24.

Subsequently, the gripper tube 24 is pivoted upward in the direction S and positions the yarn 28, also in a known manner, into a splicing device 13, which has upper and lower cutting devices 30, as is customary.

Figure 3:
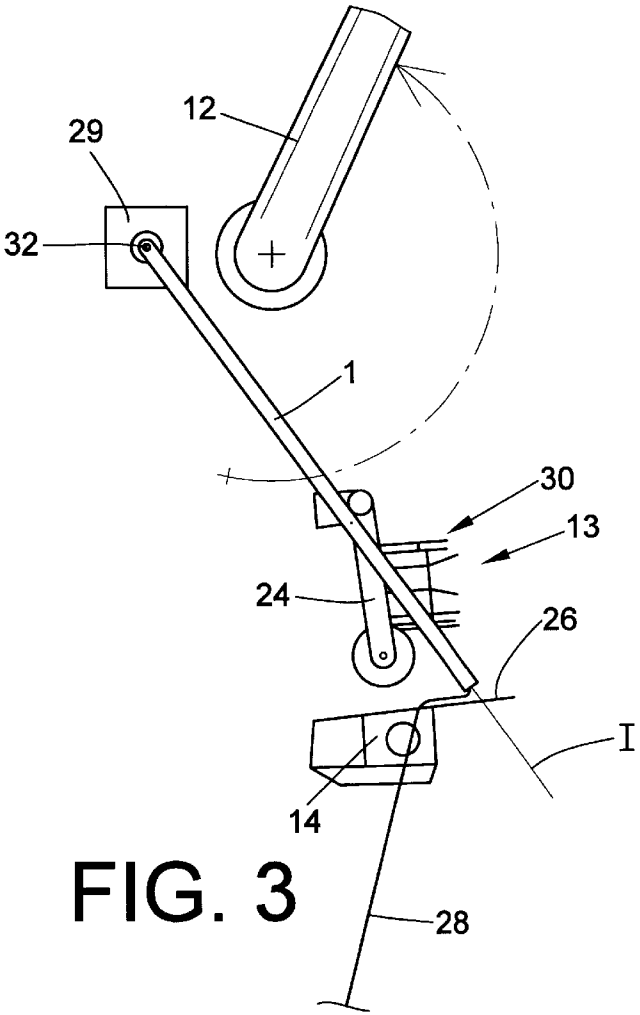
Figure 2:
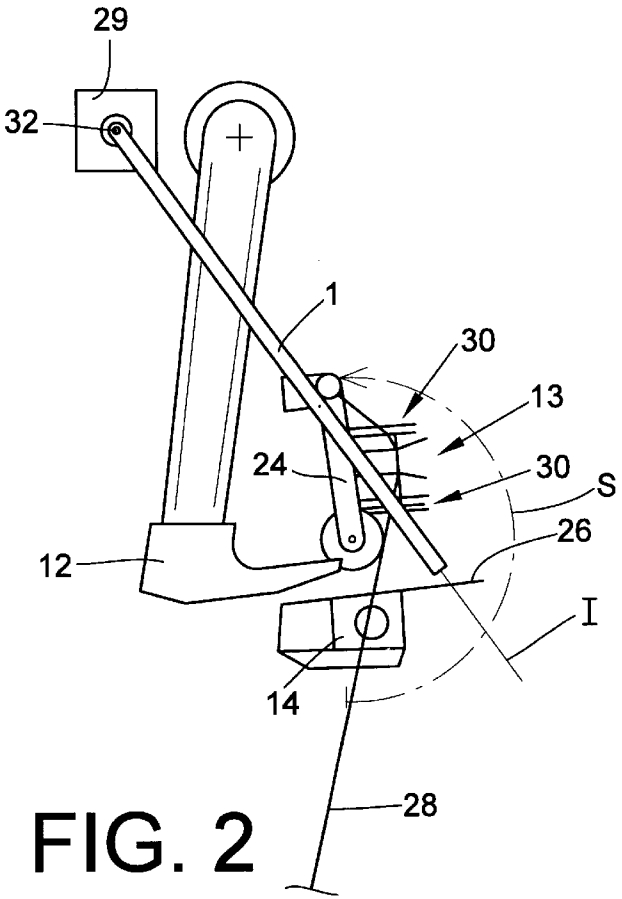

The cutting devices 30 of the splicing device 13 are operated by an additional bobbin winding head circuit (see FIG. 3), wherein the suction nozzle 12 is pivoted upwardly for fetching the upper yarn (not provided) and to place it into the splicing device 13, and in the process the yarn 28 contained in the gripper tube 24 is cut off. As indicated in FIG. 3, the yarn 28 falls on a deposit plate 26, which is arranged on the yarn tensioner 14, for example. Thus, the deposit plate 26 functions as an intermediate deposit location for the severed yarn 28, which is pneumatically picked up by the suction tube 1.

Figure 4:
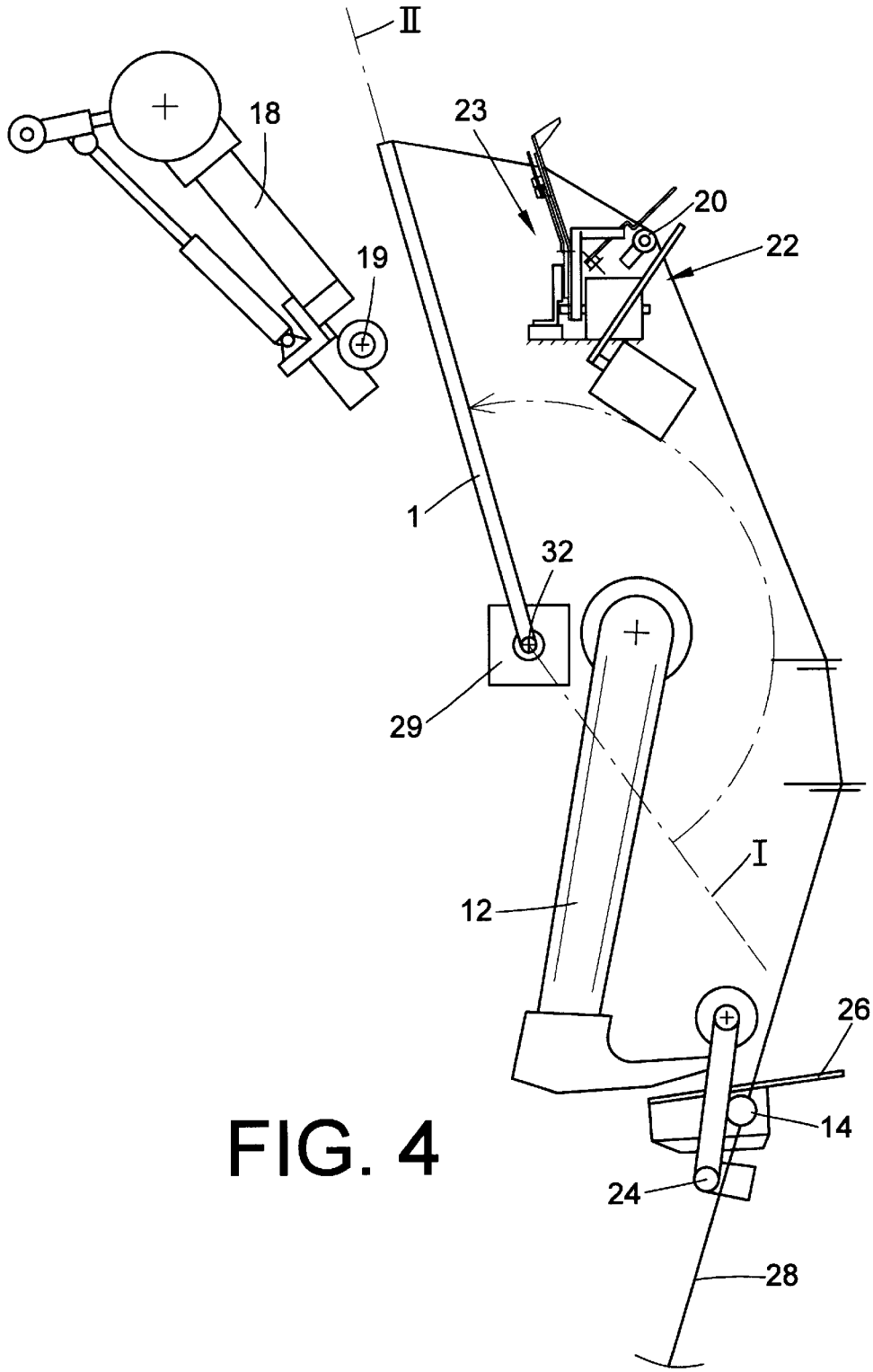
Figure 5:
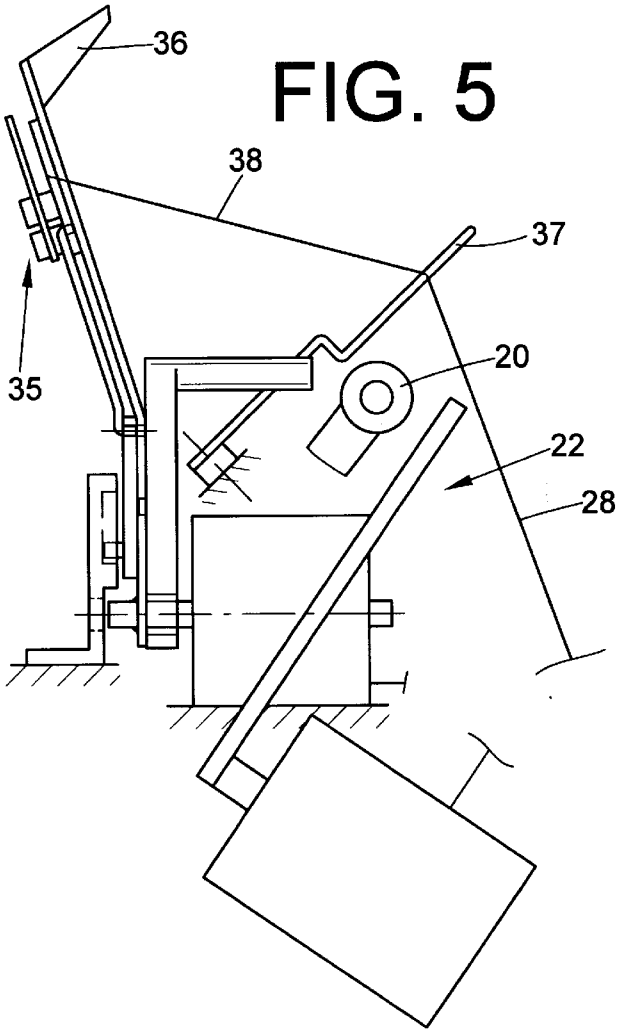

While the gripper tube 24 and the suction nozzle 12 are pivoted back into their initial positions, the suction tube 1, which is seated so that it is pivotable in a limited way around a pivot axis 32, and can be positioned in the correct position by means of a stepper motor 29, is pivoted out of the yarn receiving position I (FIG. 3) into the yarn transfer position II (FIG. 4), and the yarn 28 is transferred to a clamping and cutting device, identified as a whole by the reference numeral 23, arranged in the area of the creel 18 (FIGS. 4 and 5).

Figure 6:
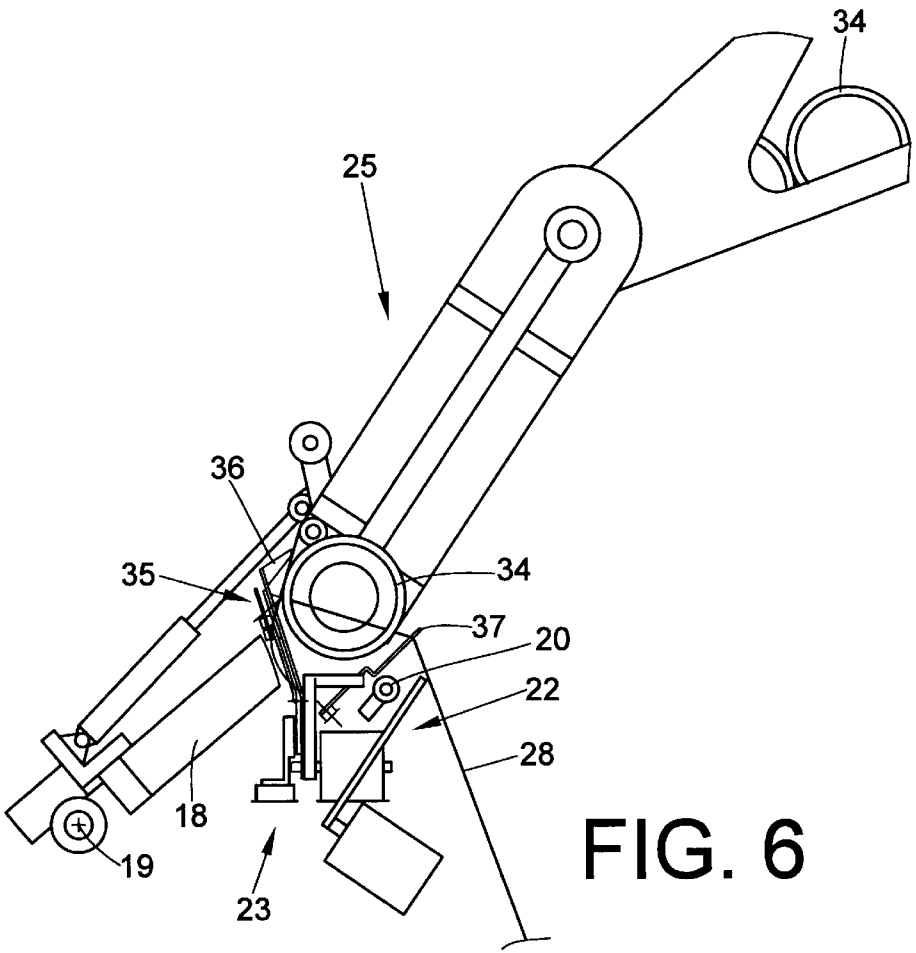

The clamping and cutting device 23 which, as indicated in FIG. 5, has a clamping/cutting element 35 arranged on a scissors lever 36 and a yarn guide lever 37, processes the yarn 28 such that a length 38 of the yarn 28 is created, and, as indicated in FIG. 6, the yarn length 38 is positioned such that, when the creel 18 is closed, the yarn length 38 is clamped between the foot of an empty tube 34, which the creel 18 had previously removed from its own empty tube reservoir 25, and a tube receiving plate of the creel 18. In this manner, the yarn of the fresh yarn batch is fixed in place on a fresh bobbin tube 34 and a fresh winding process can then be started at the respective bobbin winding head.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. In a cheese- producing textile machine having a work station comprising a creel for rotatably holding a bobbin tube, a splicing device for connecting yarn ends, and manipulating means for inserting the yarn ends into the splicing device, the manipulating means including a gripper tube for inserting a yarn connected with a feeding bobbin into a first yarn clamping and cutting device arranged in the area of the splicing device, a device for starting the work station of the cheese-producing textile machine after a yarn batch change comprising a second yarn clamping and cutting device arranged in the area of the creel, a device for receiving a yarn after cutting by the first yam clamping and cutting device, and a manipulating device for transferring the cut yarn from the receiving device to the second yarn clamping and cutting device.

2. The device in accordance with claim 1, characterized in that the manipulating device comprises a suction tube.

3. The device in accordance with claim 2, characterized in that the suction tube displaceable from a yarn receiving position into a yarn transfer position means and is supplied with a vacuum for grasping of the cut yarn.

4. The device in accordance with claim 1, characterized in that the device for receiving the cut yarn comprises a deposit plate arranged in the area of a yarn tensioner of the work station.

* * * * *